US010288296B2

(12) United States Patent
Ryu et al.

(10) Patent No.: US 10,288,296 B2
(45) Date of Patent: May 14, 2019

(54) COOKING APPLIANCE

(71) Applicant: LG ELECTRONICS INC., Seoul (KR)

(72) Inventors: Jungwan Ryu, Seoul (KR); Dongho Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 522 days.

(21) Appl. No.: 14/863,722

(22) Filed: Sep. 24, 2015

(65) Prior Publication Data

US 2016/0187002 A1 Jun. 30, 2016

(30) Foreign Application Priority Data

Dec. 31, 2014 (KR) ..... 10-2014-0195200

(51) Int. Cl.
*F24C 15/10* (2006.01)
*F24C 15/00* (2006.01)
*F24C 15/08* (2006.01)

(52) U.S. Cl.
CPC ..... *F24C 15/101* (2013.01); *F24C 15/006* (2013.01); *F24C 15/08* (2013.01)

(58) Field of Classification Search
CPC ..... F24C 15/101; F24C 15/006; F24C 15/08
USPC ..... 126/214 D
See application file for complete search history.

(56) References Cited

U.S. PATENT DOCUMENTS 6,172,338 B1 * 1/2001 Barnes ..... F24C 15/006 126/21 R
2007/0074713 A1 * 4/2007 Cadima ..... F24C 15/006 126/21 R
2012/0037142 A1 * 2/2012 Chilton ..... F24C 3/008 126/21 R

FOREIGN PATENT DOCUMENTS

GB 1433354 A * 4/1976 ..... F24C 15/101
JP 02013720 A * 1/1990
JP 2006-090617 4/2006
KR 20-1994-0006763 9/1994
KR 10-0402621 10/2003
KR 10-0540560 1/2006

OTHER PUBLICATIONS

Notice of Allowance issued in Korean Application No. 10-2014-0195200 dated Jun. 16, 2016, 3 pages, (with English translation).

* cited by examiner

*Primary Examiner* — Jason Lau
(74) *Attorney, Agent, or Firm* — Fish & Richardson P.C.

(57) ABSTRACT

A cooking appliance includes a cabinet that defines an external appearance of the cooking appliance, a top plate disposed on an upper surface of the cabinet and provided with one or more first cooking units configured to execute cooking using a heat source, and a second cooking unit provided within the cabinet and configured to execute cooking using a heat source. The top plate includes protrusions protruding upward from both widthwise side parts of the top plate and a recess formed at a widthwise inner part of the top plate between the protrusions. The top plate also includes blocking members configured to block heat generated from the one or more first cooking units from being transmitted to the widthwise side parts of the top plate.

17 Claims, 7 Drawing Sheets

COOKING APPLIANCE

Pursuant to 35 U.S.C. § 119(a), this application claims the benefit of Korean Patent Application No. 10-2014-0195200, filed on Dec. 31, 2014, which is hereby incorporated by reference as if fully set forth herein.

FIELD

The present disclosure relates to a cooking appliance, and more particularly, to a cooking appliance configured to prevent an increase in the temperature of the side surfaces of a top plate.

BACKGROUND

In general, cooking appliances include products that cook food at home or indoors using electricity or other energy sources (for example, gas). Cooking appliances include cooking appliances using gas as a heat source, such as a gas range, a gas oven and a gas oven range, cooking appliances using electricity as a heat source, such as an induction range and a microwave oven, and cooking appliances in which an induction range using electricity and a gas oven using gas are combined. In the case of a gas oven range, a gas range may be disposed at the upper region as a first cooking unit and a gas oven may be disposed at the lower region under the gas range as a second cooking unit. Further, the first cooking unit may be installed on a top plate disposed above the second cooking unit. The top plate may be exposed to the outside of the cooking appliance. Therefore, while a user uses the cooking appliance, the user may touch or contact the top plate with his/her hands. For instance, the user may touch or contact both side parts of the top plate in the width direction with his/her hands.

Also, when cooking is performed through the first cooking unit, heat generated from the first cooking unit may be transmitted to the top plate. For example, when cooking is performed through the first cooking unit, heat generated from the first cooking unit may be transmitted to both side parts of the top plate in the width direction through air convection under the top plate. If heat generated from the first cooking unit is transmitted to both side parts of the top plate in the width direction, the temperature of the side parts of the top plate in the width direction may increase. If the temperature becomes too high, the user may get burned due to the increase in the temperature of the side parts of the top plate in the width direction.

SUMMARY

In one aspect, a cooking appliance comprises a cabinet that defines an external appearance of the cooking appliance, a top plate disposed on an upper surface of the cabinet and provided with one or more first cooking units configured to execute cooking using a heat source, and a second cooking unit provided within the cabinet and configured to execute cooking using a heat source. The top plate includes protrusions that protrude upward from both widthwise side parts of the top plate and a recess defined at a widthwise inner part of the top plate between the protrusions. The one or more first cooking units are disposed on the recess. The top plate also includes blocking members that are provided under an upper surface of the top plate and that are configured to block heat generated from the one or more first cooking units from being transmitted to the widthwise side parts of the top plate.

Implementations may include one or more of the following features. For example, the blocking members may be configured to block heat generated from the one or more first cooking units from being transmitted from a center of an area under the upper surface of the top plate to the widthwise side parts of the top plate.

In some implementations, the blocking members may be arranged in a perpendicular direction under the upper surface of the top plate. In these implementations, each of the protrusions may include a first wall arranged in the perpendicular direction, a second wall that is separated from the first wall, that is located outward of the first wall in a width direction of the top plate, and that is arranged in the perpendicular direction, and a third wall connecting a top end of the first wall and a top end of the second wall to each other.

The blocking member may be provided under the third wall. The blocking member may be disposed between the first wall and the second wall. The blocking member may be disposed closer to the first wall than the second wall. The blocking member may be disposed in parallel with the first wall and the second wall. The third wall may be arranged in parallel with a mounting surface of the cabinet and a size of the first wall in a height direction is less than a size of the second wall in the height direction.

In some examples, the blocking member may be disposed such that an upper end of the blocking member contacts a lower surface of the third wall. In these examples, the blocking member may include a first surface facing the first wall and a second surface facing the second wall and the blocking member may be disposed under the third wall with the first surface of the blocking member contacting the first wall.

In some implementations, a first air flow channel through which air flows from a front portion to a rear portion of the top plate may be defined between the second surface of the blocking member and the second wall of the protrusion and a second air flow channel through which air flows from the front portion to the rear portion of the top plate may be defined between a lower surface of the recess of the top plate and the first surface of the blocking member. In these implementations, side walls of the second cooking unit and side walls of the cabinet may be separated from each other and external air introduced from a lower portion of the cabinet flows into the first air flow channel and the second air flow channel through spaces between the side walls of the second cooking unit and the side walls of the cabinet.

In some examples, side brackets may be provided at both widthwise side parts of the lower portion of the cabinet and a rear bracket may be provided at a rear region of the lower portion of the cabinet. In these examples, one or more first air influx holes may be located on the side brackets and one or more second air influx holes may be located on the rear bracket. External air may be introduced into the cabinet through the one or more first air influx holes and the one or more second air influx holes.

In some implementations, the cooking appliance may include a rear panel installed at a rear portion of the cabinet at an area above the cabinet. The rear panel may include a control command input unit configured to control the second cooking unit. In these implementations, the cooking appliance also may include a first discharge hole that is provided on a front surface of the rear panel and that is configured to discharge at least a part of air flowing below the top plate and air flowing within the cabinet to outside of the cooking appliance.

In some examples, the cabinet may include a rear wall configured to cover the rear portion of the cabinet and the cooking appliance may include one or more second discharge holes that are provided on the rear wall and that are configured to discharge at least a part of air flowing below the top plate and air flowing within the cabinet to the outside of the cooking appliance. In these examples, the cooking appliance may include one or more third discharge holes that are located on a rear surface part of the rear panel and that are configured to discharge at least a part of air flowing below the top plate and air flowing within the cabinet to the outside of the cooking appliance.

In some implementations, upper ends of the blocking members may be bent toward the second walls at a predetermined curvature. In these implementations, the blocking members may include fixing ribs protruding toward both widthwise side walls of the cabinet and the fixing ribs may be fixed to the upper ends of the widthwise side walls of the cabinet.

The one or more first cooking units may include multiple first cooking units. The blocking members may be configured to prevent heat generated from the one or more first cooking units from being transmitted to the widthwise side parts of the top plate.

It is to be understood that the description presented throughout this application is exemplary and explanatory and intended to provide further explanation of the subject matter claimed.

DETAILED DESCRIPTION

Figure 1:
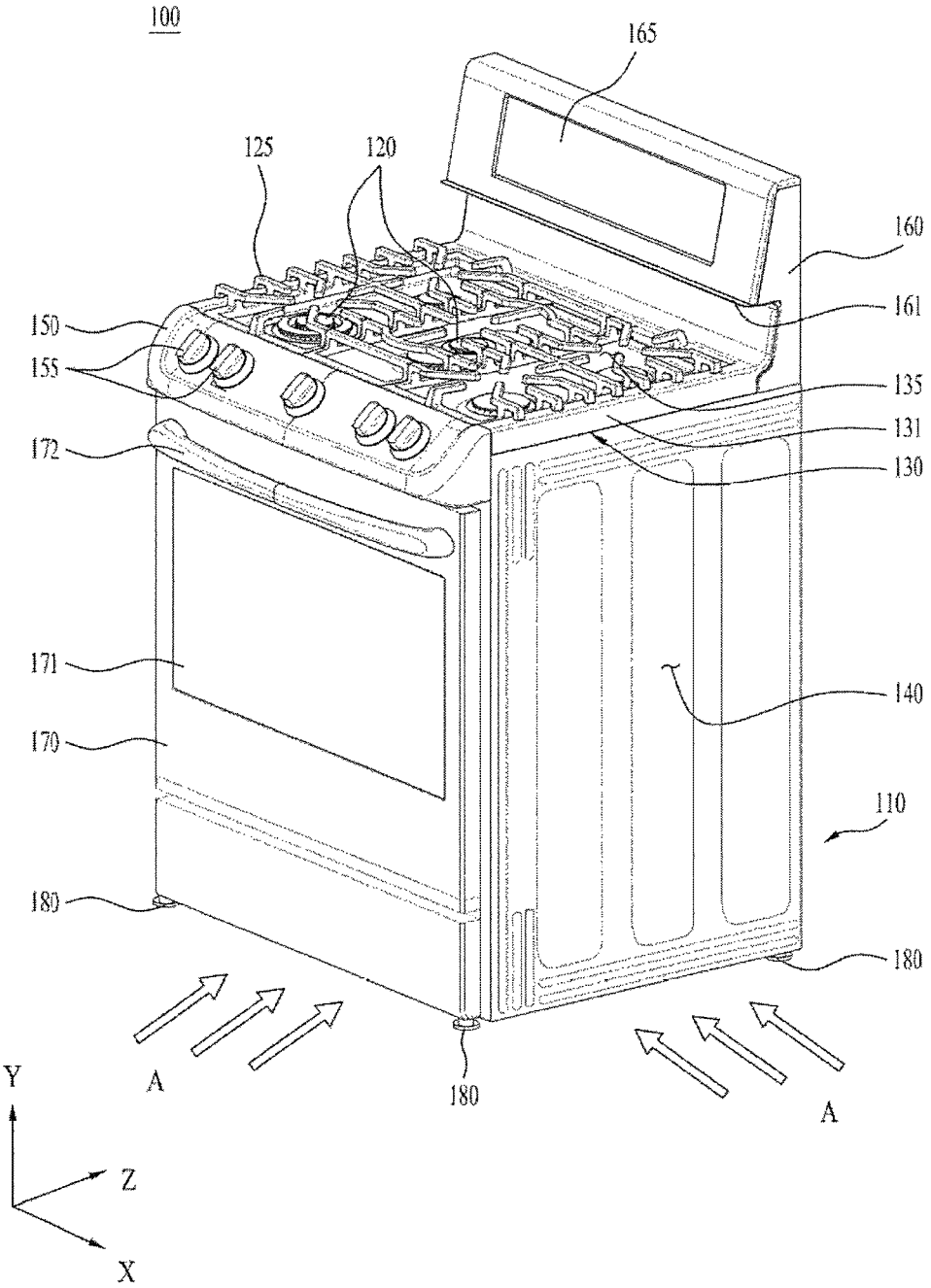
FIG. 1 is a perspective view of an example cooking appliance.

FIG. 1 illustrates an example cooking appliance. Hereinafter, for convenience of description, a cooking appliance using gas as a heat source will be described, but those skilled in the art will appreciate that features of the present disclosure may be applied to other types of cooking appliances, such as a cooking appliance using electricity as a heat source.

In FIG. 1, an X-axis direction may be defined as the width direction of the cooking appliance, a Y-axis direction may be defined as the height direction of the cooking appliance, and a Z-axis direction may be defined as the forward and backward depth direction of the cooking appliance. Also, the X-axis, the Y-axis and the Z-axis directions may be the width direction, the height direction and the forward and backward depth direction of a cabinet or a top plate.

With reference to FIG. 1, a cooking appliance 100 may include a cabinet 110 forming an external appearance of the cooking appliance 100, a top plate 130 disposed on the upper surface of the cabinet 110 and provided with first cooking units 120, a second cooking unit 140 provided within the cabinet 110, a control panel 150 combined with the front surface of the top plate 130, and a door 170 installed on the front surface of the cabinet 110 and configured to open and close the second cooking unit 140.

The second cooking unit 140 performs cooking using a heat source. A space to receive the second cooking unit 140 may be formed within the cabinet 110 and the cabinet 110 may include two widthwise side walls 118 and a rear wall 116 (see FIGS. 3, 5, and 7).

The top plate 130 may be seated on the upper surface of the cabinet 110. Further, the top plate 130 may include protrusions 131 formed at both widthwise side parts of the top plate 130 and a recess 135 provided between the protrusions 131.

In more detail, the protrusions 131 may protrude upward from both widthwise side parts of the top plate 130. Further, the recess 135 may be formed at a widthwise inner part of the top plate 131 between the protrusions 131.

Further, one or more first cooking units 120 performing cooking using the heat source may be disposed on the recess 135. For example, the first cooking units 120 may be installed on the recess 135 so that the upper portions of the first cooking units 120 are exposed to the outside.

The heat source used by the first cooking units 120 and the second cooking unit 140 may be gas or electricity. Hereinafter, the case in that gas is used as the heat source will be exemplarily described.

The first cooking units 120 may be igniters which generate a flame by burning gas. That is, gas may be supplied from a gas supply source to the first cooking units 120 and the first cooking units 120 may generate a flame by burning the supplied gas so as to generate heat needed to cook food.

Further, one or more cooking vessel supporters 125 may be disposed on the first cooking units 120. Particularly, the cooking vessel supporters 125 may be disposed on the top plate 130 so as to support cooking vessels placed on the first cooking units 120.

The configuration of the cooking units or igniters 120 using gas is generally known as a gas range and a detailed description thereof will thus be omitted.

The second cooking unit 140 may be provided within the cabinet 110. For example, the second cooking unit 140 may define a cavity or a chamber within the cabinet 120.

Further, a heating unit configured to heat food in the second cooking unit 140 using gas as a heat source may be provided within the cabinet 110.

For example, gas may be supplied from the gas supply source to the second cooking unit 140 and the heating unit provided in the second cooking unit 140 may be configured to generate a flame or heat by burning the supplied gas so as to generate heat needed to cook food.

Such a second cooking unit 140 represents a generally known gas oven and a detailed description of the operating method (or cooking method) of the second cooking unit 140 will thus be omitted.

The control panel 150 may be combined with the front surface of the top plate 130. In more detail, the control panel 150 may be combined with the top plate 130 from an area above the door 170 provided on the front surface of the cabinet 110 so as to open and close the second cooking unit 140.

The door 170 is provided on the front surface of the cabinet 110 so as to open and close the second cooking unit 140 and may include a transparent part 171 that enables a user to observe the inside of the second cooking unit 140 and a handle part 172 to open and close the door 170.

One or more control units 155 may be provided on the control panel 150. For instance, the control units 155 may be rotatable knobs.

A user may rotate the control unit 155 to generate a flame by burning gas supplied to the first cooking unit 120 or to adjust intensity of the flame of the first cooking unit 120.

Further, the cooking appliance 100 may include a rear panel 160 installed at the rear portion of an area above the cabinet 110. A control command input unit 165 to control the second cooking unit 140 may be installed on the rear panel 160. The control command input unit 165 may be provided on the front surface of the rear panel 160 and may include a touch panel.

Further, the control command input unit 165 may display information regarding cooking performed by the second cooking unit 140 (for example, a cooking course and a cooking time).

A first discharge hole 161 to discharge at least a part of air flowing below the top plate 130 and air flowing within the cabinet 110 to the outside may be provided on the rear panel 160.

Here, the first discharge hole 161 may extend throughout the widthwise length of the rear panel 160. Further, the first discharge hole 161 may be formed below the control command input unit 165 on the rear panel 160. The first discharge hole 161 may discharge at least a part of air flowing below the top plate 130 and air flowing within the cabinet 110 in the forward direction of the rear panel 160.

For example, a discharge channel may be formed within the rear panel 160 and at least a part of air flowing below the top plate 130 and air flowing within the cabinet 110 may be discharged through the first discharge hole 161 via the discharge channel.

Therefore, when a user uses at least one of the first cooking units 120 and the second cooking unit 140, at least a part of high-temperature air generated below the top plate 130 and in the cabinet 110 may be discharged to the outside through the first discharge hole 161.

One or more legs 180 may be installed under the cabinet 110 so as to space the cabinet 110 upward from the mounting surface of the cooking appliance 100. For example, four legs 180 may be provided under the cabinet 110 and the four legs 180 may be provided at four corners of the lower surface of the cabinet 110.

In order to discharge high-temperature air generated from the first cooking units 120 and the second cooking unit 140 to the outside of the cooking appliance 100 or to lower the temperature of high-temperature air, external air (for example, low-temperature external air) needs to be introduced into the cabinet 110. Therefore, the lower surface of the cabinet 110 is separated upward from the mounting surface of the cooking appliance 100 by the legs 180. Here, external air at the outside of the cooking appliance 100 may be introduced into the cabinet 110 through the lower portion of the cabinet 110 from the front surface of the cabinet 110 and both widthwise side surfaces of the cabinet 110.

For example, as shown by arrows A of FIG. 1, external air may be introduced into the cooking appliance 100 through the lower portion of the cabinet 110 from the front surface of the cooking appliance 100 and both widthwise side surfaces of the cooking appliance 100. Hereinafter, the flow of external air which is introduced into the lower portion of the cabinet 110 and then flows to the inside of the cabinet 110 will be described.

Figure 2:
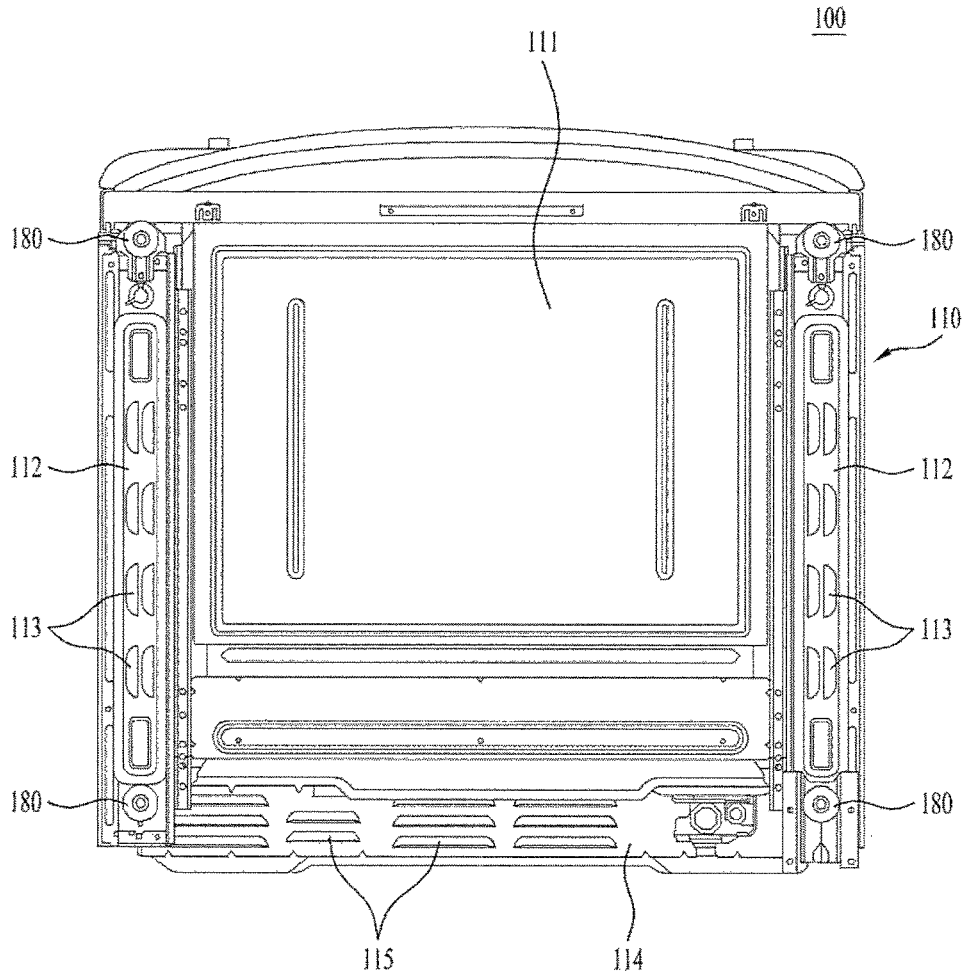
FIG. 2 is a bottom view of the example cooking appliance shown in FIG. 1.

FIG. 2 shows a bottom view of the example cooking appliance shown in FIG. 1. With reference to FIG. 2, a bottom surface 111 to cover at least a part of the lower portion of the cabinet 110 may be provided on the lower portion of the cabinet 110.

Further, side brackets 112 may be disposed at both widthwise side parts of the lower portion of the cabinet 110. For example, two side brackets 112 may be installed at both widthwise side parts of the lower portion of the cabinet 110. The side brackets 112 may connect the lower ends of the widthwise side walls 118 to the bottom surface 111 of the cabinet 110. The one or more legs 180 may be installed on the side brackets 112. The legs 180 may protrude toward the mounting surface of the cabinet 110 (e.g., the mounting surface of the cooking appliance 100) from the side brackets 112. Therefore, the lower portion of the cabinet 110 may be separated upward from the mounting surface of the cabinet 110 (e.g., the mounting surface of the cooking appliance 100) by a predetermined interval.

Further, one or more first air influx holes 113 may be formed on the side brackets 112. The first air influx holes 113 may be formed as slits having a circular shape or a predetermined length.

Therefore, at least a part of external air introduced into the lower portion of the cabinet 110 from the front surface or both widthwise side surfaces of the cabinet 110 (with reference to arrows A of FIG. 1) may be introduced into the cabinet 110 through the first air influx holes 113 formed on the side brackets 112.

Further, a rear bracket 114 may be disposed at the rear region of the lower portion of the cabinet 110. Both lengthwise ends of the rear bracket 114 may be combined with a lengthwise end of each of the two side brackets 112.

One or more second air influx holes 115 may be formed on the rear bracket 114. The second air influx holes 115 may be formed as slits having a circular shape or a predetermined length.

Therefore, at least a part of external air introduced into the lower portion of the cabinet 110 from the front surface or both widthwise side surfaces of the cabinet 110 (with reference to arrows A of FIG. 1) may be introduced into the cabinet 110 through the second air influx holes 115 formed on the rear bracket 114.

External air (low-temperature air) introduced into the cabinet 110 may form an air flow to discharge high-temperature air generated from at least one of the first cooking units 120 and the second cooking unit 140 to the outside of the cooking appliance 100.

Further, external air (low-temperature air) introduced into the cabinet 110 may be mixed with high-temperature air generated from at least one of the first cooking units 120 and the second cooking unit 140 and serve to lower the temperature of the high-temperature air. Hereinafter, the flow of external air which is introduced into the cabinet 110 from the lower portion of the cabinet 110 (e.g., the lower portion of the cooking appliance 100) will be described below with reference to FIG. 4.

Figure 3:
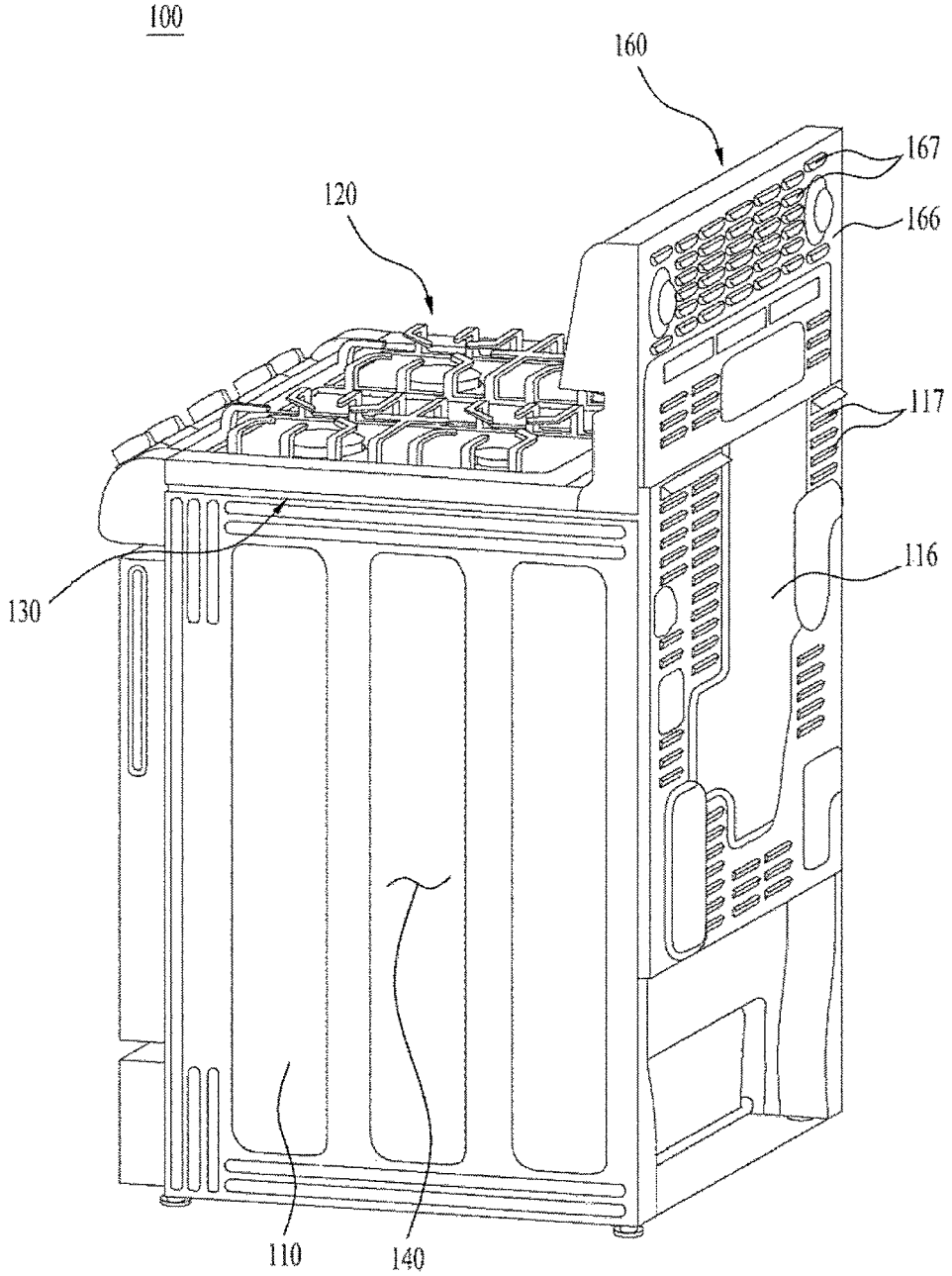
FIG. 3 is a perspective rear view of the example cooking appliance shown in FIG. 1.

FIG. 3 is a perspective rear view of the example cooking appliance shown in FIG. 1. With reference to FIG. 3, the rear wall 116 of the cabinet 110 is disposed at the rear portion of the cabinet 110. That is, the rear wall 116 may cover the rear portion of the cabinet 110.

Here, one or more second discharge holes 117 may be formed on the rear wall 116. Therefore, when at least one of the first cooking units 120 and the second cooking unit 140 is driven, at least a part of high-temperature air present below the top plate 130 or within the cabinet 110 may be discharged to the outside of the cabinet 110 (e.g., the outside of the cooking appliance 100) through the second discharge holes 117. That is, when at least one of the first cooking units 120 and the second cooking unit 140 is driven, high-temperature air may be formed in at least one of an area below the top plate 130 and the inside of the cabinet 110.

Further, the high-temperature air may cause an ascending air current within the cabinet 110. Here, external air (for example, relatively low-temperature air) introduced into the cabinet 110 through the lower portion of the cabinet 110 or the lower portion of the cooking appliance 100, as described with reference to FIG. 2, flows upward within the cabinet 110.

Then, the external air may be discharged to the outside through the second discharge holes 117 while being mixed with the high-temperature air. Further, the external air serves to lower heat generated from the first cooking units 120 and the second cooking unit 140. That is, the external air may lower the temperature of high-temperature air generated from the circumference of the first cooking units 120 or the second cooking unit 140 by driving at least one of the first cooking units 120 and the second cooking unit 140.

The rear panel 160 may include a rear surface part 166 to cover the rear portion of the rear panel 160. One or more third discharge holes 167 may be formed on the rear surface part 166 of the rear panel 160.

Therefore, the external air together with the high-temperature air, generated from the circumference of the first cooking units 120 or the second cooking unit 140 by driving at least one of the first cooking units 120 and the second cooking unit 140, may be discharged to the outside through the third discharge holes 167.

As described above, external air introduced into the cabinet 110 and high-temperature air generated from the inside of the cabinet 110 may be discharged to the outside through at least one of the first discharge hole 161 shown in FIG. 1, the second discharge holes 117, and the third discharge holes 167.

Air introduced from the lower portion of the cabinet 110 to the inside of the cabinet 110 may flow upward through spaces between the cabinet 110 and the second cooking unit 140. Hereinafter, such an air flow path will be described in detail with reference to FIG. 4.

Figure 4:
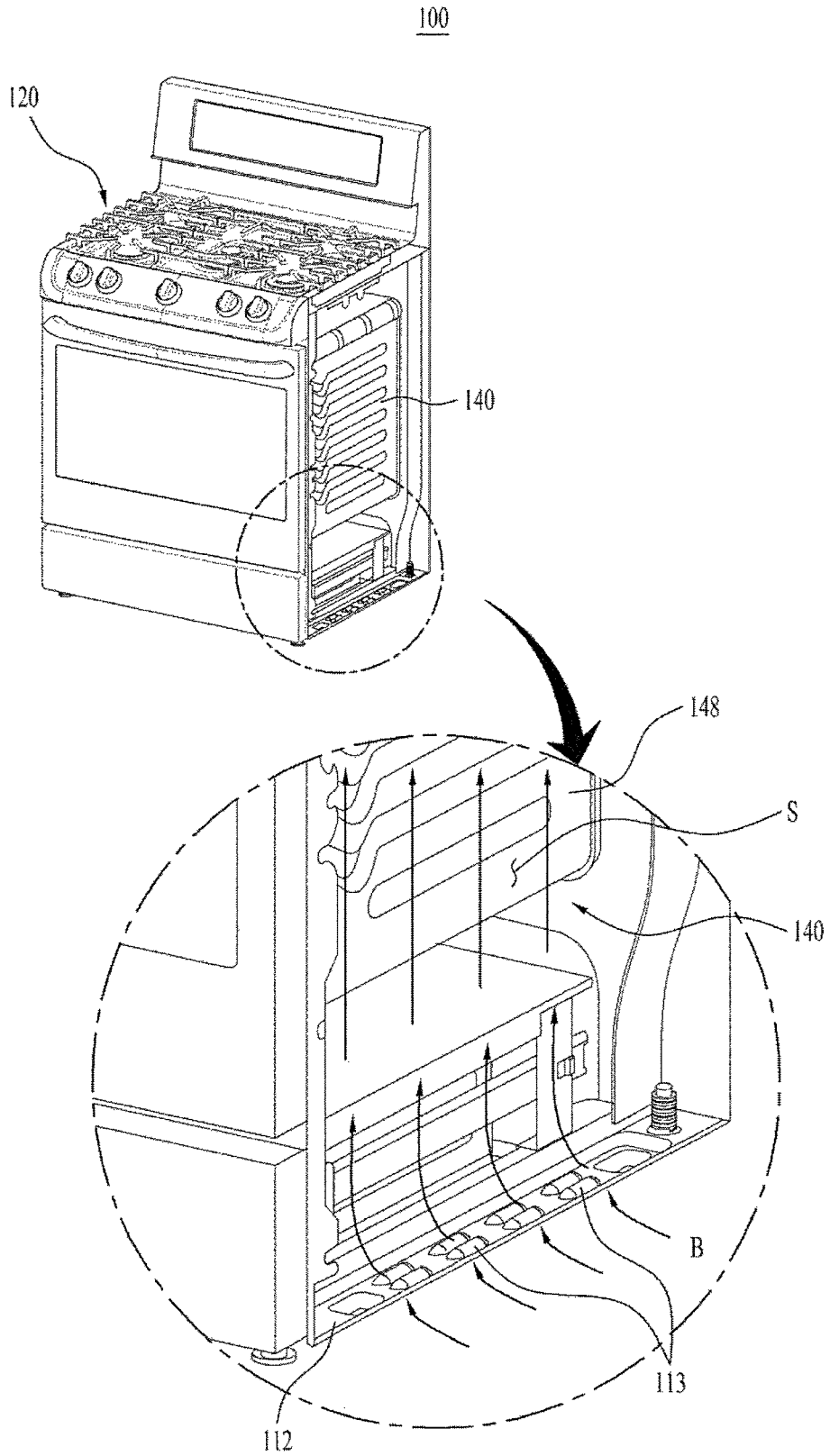
FIG. 4 is an exploded perspective side view illustrating example elements of the example cooking appliance shown in FIG. 1.

FIG. 4 is an exploded perspective side view illustrating example elements of the example cooking appliance shown in FIG. 1. In particular, FIG. 4 is an exploded perspective side view in which one widthwise side surface of the cabinet 110 of the cooking appliance 100 shown in FIG. 1 is exploded. Hereinafter, the configuration of one widthwise side surface of the cabinet 110 will be described, but the same configuration may be applied to the other widthwise side surface of the cabinet 110.

With reference to FIGS. 1 and 4, the cabinet 110 may include the side walls 118 disposed at both widthwise side surfaces of the cabinet 110. Further, the second cooking unit 140 includes side walls 148 disposed at both widthwise side surfaces of the second cooking unit 140.

Here, the side walls 118 of the cabinet 110 and the side walls 148 of the second cooking unit 140 disposed opposite the side walls 118 of the cabinet 110 may be separated from each other. That is, the second cooking unit 140 may be disposed within the cabinet 110 so that the side walls 118 of the cabinet 110 and the side walls 148 of the second cooking unit 140 may be separated from each other. A space S may be formed between the side wall 118 of the cabinet 110 and the side wall 148 of the second cooking unit 140.

Therefore, external air introduced through the lower portion of the cabinet 110 may flow upward within the cabinet 110 through the space S formed between the side walls 118 of the cabinet 110 and the side walls 148 of the second cooking unit 140. For example, as shown in FIG. 4, relatively low-temperature external air and relatively high-temperature air within the cabinet 110 may flow upward in the direction of arrows B in the space S.

At least a part of air flowing upward within the cabinet 110 may flow to the area under the top plate 130 and then be discharged to the outside through one of the above-described first discharge hole 161, second discharge holes 117, and third discharge holes 167. Hereinafter, an air flow under the top plate 130 will be described in detail with reference to FIG. 5.

Figure 5:
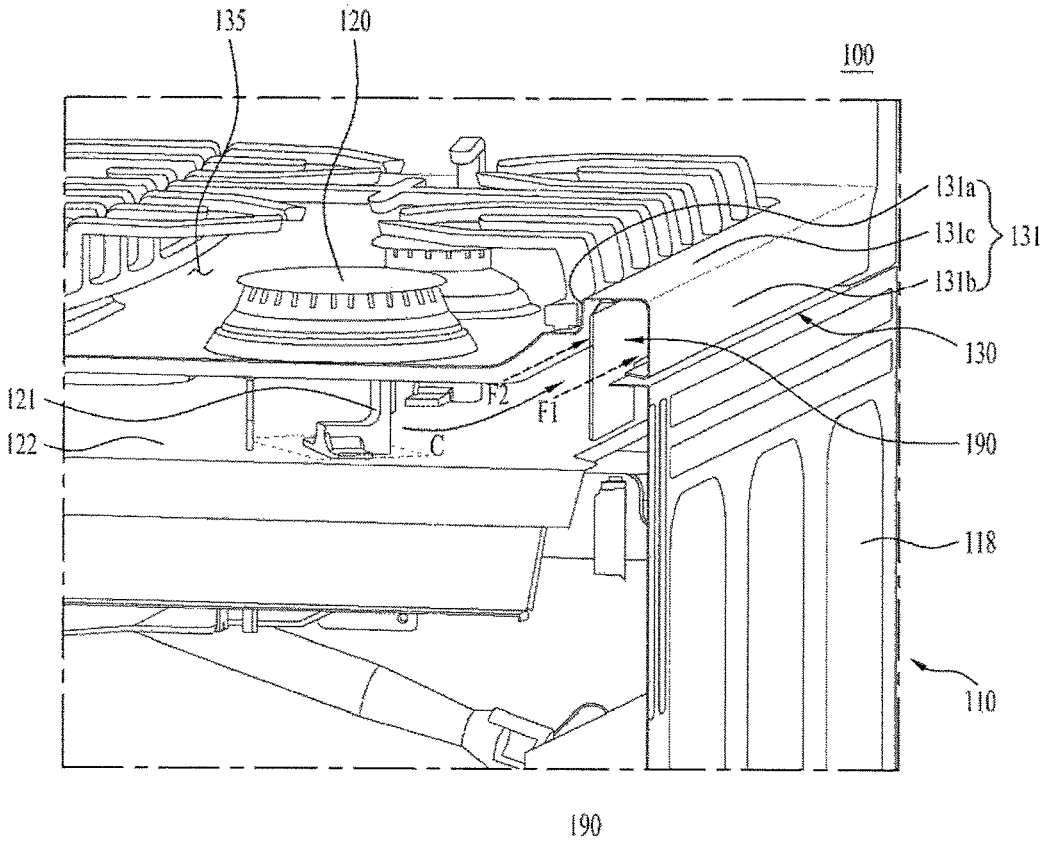
FIG. 5 is a perspective view illustrating a lower portion of an example top plate of the example cooking appliance shown in FIG. 1.

FIG. 5 illustrating a lower portion of the example top plate of the example cooking appliance shown in FIG. 1. Hereinafter, the detailed configuration of one widthwise side part of the top plate 130 will be described, but the same configuration may be applied to the other widthwise side part of the top plate 130.

With reference to FIGS. 1 and 5, the top plate 130 provided on the cabinet 110 may include the protrusions 131 protruding upward from both widthwise side parts of the top plate 130.

Further, the top plate 130 may include the recess 135 formed at the widthwise inner part of the top plate 130 between the protrusions 131. That is, the recess 135 may be formed at the widthwise inner part of the top plate 130 between the protrusions 131.

The first cooking units 120 may be disposed on the recess 135. For example, the first cooking units 120 may be installed on the recess 135 so that at least a part of each of the first cooking units 120 is exposed to the outside.

Further, holders 121 to fix a gas supply line to supply gas to the first cooking units 120 may be disposed under the recess 135. The holders 121 may be formed to connect the first cooking units 120 to the gas supply line. Further, the holders 121 may be seated on a holder supporter 122. The holder supporter 122 may be disposed below the top plate 130 so as to be separated from the top plate 130. That is, the holders 121 may be connected to the first cooking units 120 between the top plate 130 and the holder supporter 122. Therefore, a space may be formed between the top plate 130 and the holder supporter 122 and heat generated from the first cooking units 120 may raise the temperature of air between the top plate 130 and the holder supporter 122.

Blocking members 190 to prevent heat, generated from at least one of the first cooking units 120 and the second cooking unit 140, from being transmitted to the widthwise side parts of the top plate 130 may be provided under the top plate 130. For example, the blocking members 190 may prevent heat, generated from the first cooking units 120, from being transmitted from the center of the area under the top plate 130 to the widthwise side parts of the top plate 130. That is, the blocking members 190 may be formed to prevent heat, generated from the first cooking units 120, from being transmitted from the area under the recess 135 of the top plate 130 to both widthwise side regions of the area under the top plate 130.

Further, the blocking members 190 may be disposed in the perpendicular direction under the top plate 130. Therefore, heat generated from the first cooking units 120 may be blocked by the blocking members 190 while the heat is transmitted to both widthwise side parts of the top plate 130.

The protrusion 131 formed on the top plate 130 may include a first wall 131*a*, a second wall 131*b* separated from the first wall 131*a*, and a third wall 131*c* connecting the first wall 131*a* and the second wall 131*b* to each other. The first wall 131*a* may be formed in the perpendicular direction and disposed inward in the width direction of the top plate 130, as compared to the second wall 131*b*.

The second wall 131*b* may be formed in the perpendicular direction and separated from the first wall 131*a* outward in the width direction of the top plate 130. That is, the second walls 131*b* may form both widthwise side surfaces of the top plate 130. For instance, the second walls 131*b* may form the widthwise outermost surfaces of the top plate 130. Therefore, the second walls 131*b* may be disposed at positions which a user may easily touch and contact.

The third wall 131*c* may be formed to connect the upper end of the first wall 131*a* and the upper end of the second wall 131*b* to each other. Here, the third wall 131*c* may be provided in parallel with the mounting surface of the cabinet 110.

The protrusions 131 may extend in the forward and backward direction of the top plate 130. Therefore, the first walls 131*a*, the second walls 131*b*, and the third walls 131*c* may also extend in the forward and backward direction of the top plate 130.

Further, the blocking members 190 may extend in the forward and backward direction of the top plate 130. The blocking members 190 may be provided under the third walls 131*c*. That is, the blocking members 190 may be disposed in the perpendicular direction under the third walls 131*c*.

Further, the blocking members 190 may be disposed in parallel with the first walls 131*a* and the second walls 131*b*. The blocking members 190 may be formed such that the size of the blocking members 190 in the height direction is greater than the size of the first walls 131*a* in the height direction and is equal to the size of the second walls 131*b* in the height direction. Therefore, a flow of heat generated from the first cooking units 120 toward the second walls 131*b* may be blocked by the blocking members 190.

Further, in order to increase blocking efficiency of heat toward the second walls 131*b*, the blocking members 190 may be disposed between the first walls 131*a* and the second walls 131*b*. In some examples, the blocking members 190 may be disposed closer to the first walls 131*a* than the second walls 131*b*. Since the blocking members 190 are disposed closer to the first walls 131*a* than the second walls 131*b*, spaces may be formed between the blocking members 190 and the second walls 131*b*. Therefore, heat generated from the first cooking units 120 needs to pass through the blocking members 190 and the spaces during transmission of the heat to the second walls 131*b*, thereby limiting (e.g., preventing) an increase in the temperature of the second walls 131*b* based on operation of the first cooking units 120.

The space between the blocking member 190 and the second wall 131*b* may form a first air flow channel F1 extending in the forward and backward direction of the top plate 130. Further, a second air flow channel F2 extending in the forward and backward direction of the top plate 130 may be formed between the blocking member 190 and the lower surface of the recess 135. The configurations of the first air flow channel F1 and the second air flow channel F2 will be described in more detail below.

The blocking members 190 may be disposed such that the upper ends of the blocking members 190 may contact the lower surfaces of the third walls 131*c*. The reason for this is that high-temperature air tends to ascend. Because the upper end of the blocking member 190 contacts the lower surface of the third wall 131*c*, the flow of high-temperature air, generated below the first cooking unit 120, toward the second wall 131*b* through a gap between the upper end of the blocking member 190 and the lower surface of the third wall 131*c* may be prevented.

Figure 6:
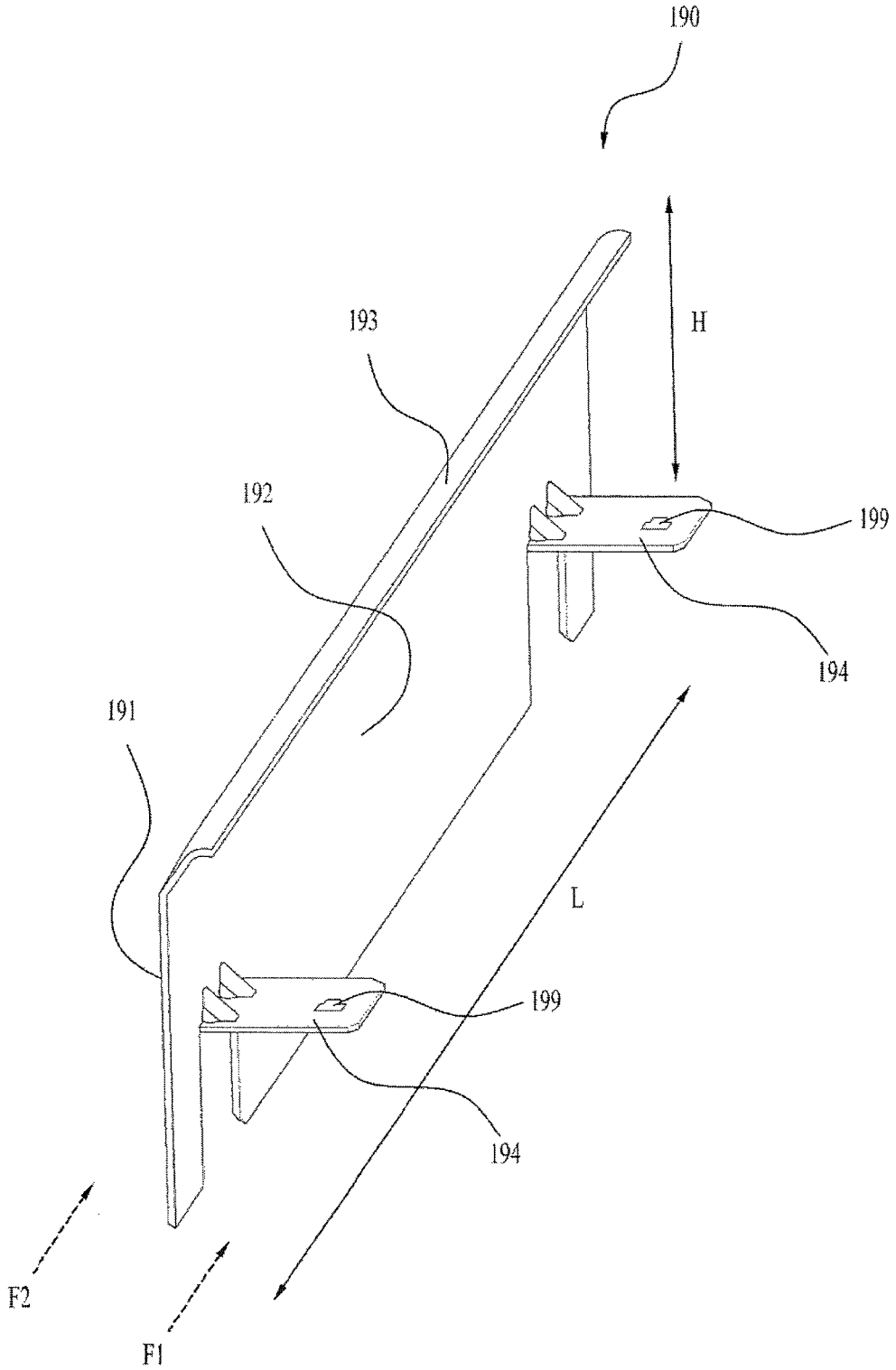
FIG. 6 is a perspective view illustrating an example blocking member provided under the example top plate shown in FIG. 5.

Hereinafter, the blocking member 190 will be described in more detail with reference to FIG. 6. FIG. 6 is a perspective view illustrating an example blocking member provided under the example top plate shown in FIG. 5.

With reference to FIGS. 5 and 6, the blocking member 190 may have a predetermined length L and a predetermined height H. Further, the blocking member 190 may be formed of a metal or a resin. For instance, the blocking member 190 is provided to block high-temperature air and, thus, the blocking member 190 may be formed of a metal.

The length of the blocking member 190 may be equal to the length of the protrusion 131 provided on the top plate 130 in the forward and backward direction. Therefore, the blocking member 190 may prevent heat, generated from the first cooking units 120, from flowing from the lower surface of the top plate 130 to the second wall 131*b* of the protrusion 131 throughout the overall length of the protrusion 131.

Further, an upper end 193 of the blocking member 190 may be bent toward the second wall 131*b* of the protrusion 131 at a predetermined curvature.

Since the upper ends 193 of the blocking members 190 are bent, when the blocking members 190 are combined with the cabinet 110 and then the top plate 130 is installed above the cabinet 110, interference between the upper ends 193 of the blocking members 190 and the lower ends of the first walls 131*a* may be reduced or prevented.

The blocking member 190 may include a first surface 191 facing the first wall 131*a* of the protrusion 131 and a second surface 192 provided at the opposite side of the first surface 191. That is, the blocking member 190 may be disposed in the perpendicular direction under the third wall 131*c* of the protrusion 131 so that the first surface 191 of the blocking member 190 faces the first wall 131*a* and the second surface 192 of the blocking member 190 faces the second wall 131*b*.

In order to secure the space between the blocking member 190 and the second wall 131*b* of the protrusion 131, the blocking member 190 may be disposed under the third wall 131*c* of the protrusion 131 so that the first surface 191 of the blocking member 190 may contact the first wall 131*a* of the protrusion 131.

The first air flow channel F1 through which air flows from the front portion to the rear portion of the top plate 130 may be provided between the second surface 192 of the blocking member 190 and the second wall 131*b* of the protrusion 131.

The first air flow channel F1 may be divided into both widthwise side portions by the second surface 192 of the blocking member 190 and the second wall 131*b* of the protrusion 131 and divided into an upper portion by the third wall 131*c* of the protrusion 131.

Further, the lower portion of the first air flow channel F1 may be opened so as to introduce air into the first air flow channel F1. The first air flow channel F1 may extend throughout the length of the top plate 130 in the forward and backward direction.

Further, the second air flow channel F2 through which air (for example, relatively high-temperature air) flows from the front portion to the rear portion of the top plate 130 may be provided between the lower surface of the recess 135 of the top plate 130 and the first surface 191 of the blocking member 190.

The second air flow channel F2 may be divided into an upper portion by the lower surface of the top plate 130 and one widthwise side portion by the first surface 191 of the blocking member 190. High-temperature air generated from the lower surface of the recess 135 due to driving of the first cooking units 120 tends to flow to the widthwise side surfaces of the top plate 130. Therefore, the second air flow channels F2 may be formed by the lower surface 130 and the first surfaces 191 of the blocking members 190.

Further, the reason why high-temperature air flows to the widthwise side surfaces of the top plate 130 is that the height of the widthwise side parts of the top plate 130 is greater than the height of the central part of the top plate 130.

External air introduced from the lower portion of the cabinet 110 flows upward through the spaces S between the side walls 148 of the second cooking unit 140 and the side walls 118 of the cabinet 110 (with reference to FIG. 4).

That is, external air introduced from the lower portion of the cabinet 110 flows to the first air flow channels F1 and the second air flow channels F2 through the spaces S between the side walls 148 of the second cooking unit 140 and the side walls 118 of the cabinet 110.

Therefore, external air introduced into the first air flow channels F1 may cool the first walls 131*a*, the second walls 131*b*, and the third walls 131*c* of the protrusions 131 while the external air flows through the first air flow channels F1. For example, external air introduced into the first air flow channels F1 may lower the temperature of the second walls 131*b* which a user contacts.

Here, the external air introduced into the first air flow channels F1 may flow toward the rear portion of the top plate 130 and be discharged to the outside through at least one of the first discharge hole 161, the second discharge holes 117, and the third discharge holes 167, as described above with reference to FIGS. 1 and 3.

Further, external air introduced into the second air flow channels F2 is mixed with high-temperature air flowing in the second air flow channels F2 due to driving of the first cooking units 120. Therefore, as the external air is introduced into the second air flow channels F2, the temperature of the high-temperature air flowing in the second air flow channels F2 may be lowered.

The external air mixed with the high-temperature air flowing in the second air flow channels F2 may flow toward the rear portion of the top plate 130 and be discharged to the outside through at least one of the first discharge hole 161, the second discharge holes 117, and the third discharge holes 167, as described above with reference to FIGS. 1 and 3.

The blocking member 190 may further include fixing ribs 194 to fix the blocking member 190 to the cabinet 110. Hereinafter, the configuration of the blocking member 190 combined with the cabinet 110 will be described in detail with reference to FIG. 7.

Figure 7:
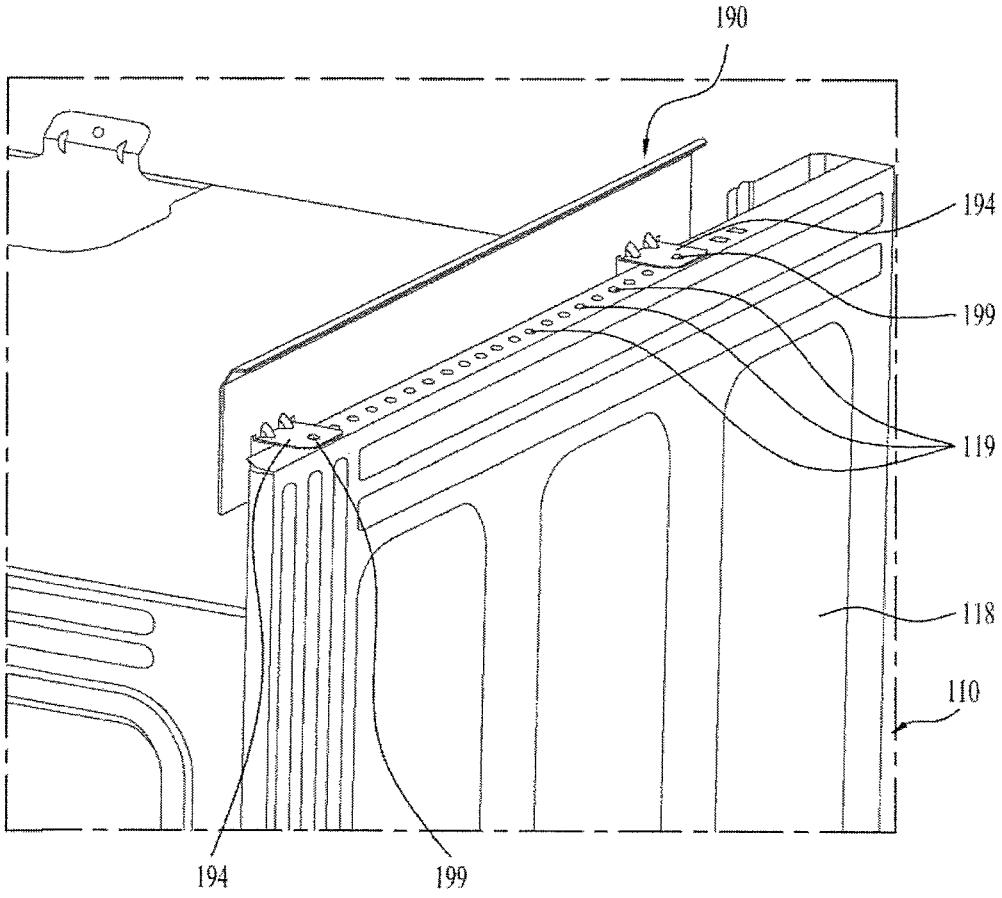
FIG. 7 is a perspective view illustrating a combined state between the example blocking member and an example cabinet shown in FIG. 6.

FIG. 7 illustrates a combined state between the blocking member and the cabinet shown in FIG. 6. With reference to FIGS. 6 and 7, the blocking member 190 may include one or more fixing ribs 194 protruding toward the side wall 118 of the cabinet 110. For example, the fixing ribs 194 may protrude from the central part of the blocking member 190 in the height direction to the side wall 118 of the cabinet 110.

Further, two fixing ribs 194 may be provided on the blocking member 190 and separated from each other by a predetermined interval in the length direction of the blocking member 190. The fixing ribs 194 may be formed integrally with the blocking member 190.

Further, the fixing ribs 194 of the blocking member 190 may be combined with the upper ends of the widthwise side walls 118 of the cabinet 110. For example, a first coupling hole 199 may be formed on each of the fixing ribs 194 and a plurality of second coupling holes 119 may be formed on the upper ends of the side walls 118 of the cabinet 110.

The second coupling holes 119 may be separated from one another by a predetermined interval in the forward and backward direction of the side walls 118 on the upper ends of the side walls 118.

Therefore, the fixing ribs 194 may be fixed to the upper end of the side wall 118 by coupling the first coupling holes 199 of the fixing ribs 194 and the second coupling holes 119 provided at positions corresponding to the first coupling holes 199 using coupling members (for example, screws and the like).

Further, as the fixing ribs 194 are fixed to the upper ends of the side walls 118, the blocking members 190 may be fixed to the side walls 118 under the condition that the second surfaces 192 of the blocking members 190 are separated from the side walls 118.

Since the plurality of second coupling holes 119 is formed on the upper ends of the side walls 118, the mounting positions (or the fixing positions) of the blocking members 190 including the two fixing ribs 194 may be easily adjusted.

For example, since the plurality of second coupling holes 119 is formed on the upper ends of the side walls 118 in the forward and backward direction of the side walls 118, the two fixing ribs 194 of the blocking members 190 may be fixed to desired positions of the upper ends of the side walls 118. That is, since the first fixing holes 199 formed on the two fixing ribs 194 may be coupled with two corresponding second coupling holes 119 from among the plurality of second coupling holes 119 on the upper ends of the side walls 118 through coupling members, a degree of freedom in disposition (or installation) of the blocking members 190 may be raised.

As apparent from the above description, a cooking appliance may prevent heat generated from cooking units from being transmitted to both widthwise side parts of a top plate on which the cooking units are installed. Further, the cooking appliance may prevent increase in the temperature of the widthwise side parts of the top plate and thus prevent a user from getting burned due to contact with the widthwise side parts of the top plate. Moreover, the cooking appliance may simplify the configuration of blocking members to prevent increase in the temperature of the widthwise side parts of the top plate and thus reduce manufacturing costs and increase mass production possibility.

It will be apparent to those skilled in the art that various modifications and variations can be made without departing from the spirit or scope of the disclosure. Thus, it is intended that the present disclosure covers modifications and variations provided they come within the scope of the appended claims and their equivalents.

What is claimed is:

1. A cooking appliance comprising:

a cabinet that defines an external appearance of the cooking appliance;

a top plate disposed on an upper surface of the cabinet and provided with one or more first cooking units configured to execute cooking using a heat source; and a second cooking unit provided within the cabinet and configured to execute cooking using a heat source, wherein the top plate includes:

protrusions that protrude upward from both widthwise side parts of the top plate;

a recess defined at a widthwise inner part of the top plate between the protrusions, the one or more first cooking units being disposed on the recess; and blocking members that are provided under an upper surface of the top plate and that are configured to block heat generated from the one or more first cooking units from being transmitted to the widthwise side parts of the top plate, wherein each protrusion includes:

a first wall that extends in a perpendicular direction with respect to the upper surface of the cabinet, a second wall that is spaced apart from the first wall in a width direction of the top plate, that is located outward of the first wall in the width direction of the top plate, and that extends in the perpendicular direction, and a third wall that connects a top end of the first wall to a top end of the second wall, wherein each blocking member is disposed under the third wall of a corresponding protrusion, each blocking member including:

an upper end that contacts a lower surface of the third wall of the corresponding protrusion, a first surface that faces the first wall of the corresponding protrusion and that contacts the first wall of the corresponding protrusion, and a second surface that faces toward the second wall of the corresponding protrusion, wherein the upper end of each blocking member is bent toward the second wall at a predetermined curvature, wherein a first air flow channel through which air flows from a front portion to a rear portion of the top plate is defined between the second surface of the blocking member and the second wall of the protrusion, and wherein a second air flow channel through which air flows from the front portion to the rear portion of the top plate is defined between a lower surface of the recess of the top plate and the first surface of the blocking member, the air flow through the second air flow channel being independent of the air flow through the first air flow channel.

2. The cooking appliance according to claim 1, wherein the blocking members are configured to block heat generated from the one or more first cooking units from being transmitted from a center of an area under the upper surface of the top plate to the widthwise side parts of the top plate.

3. The cooking appliance according to claim 1, wherein the blocking members are arranged in the perpendicular direction under the upper surface of the top plate.

4. The cooking appliance according to claim 3, wherein the blocking member is disposed between the first wall and the second wall.

5. The cooking appliance according to claim 4, wherein the blocking member is disposed closer to the first wall than the second wall.

6. The cooking appliance according to claim 3, wherein the blocking member is disposed in parallel with the first wall and the second wall.

7. The cooking appliance according to claim 3:

wherein the third wall is arranged in parallel with a mounting surface of the cabinet; and wherein a size of the first wall in a height direction is less than a size of the second wall in the height direction.

8. The cooking appliance according to claim 1:

wherein side walls of the second cooking unit and side walls of the cabinet are separated from each other; and wherein external air introduced from a lower portion of the cabinet flows into the first air flow channel and the second air flow channel through spaces between the side walls of the second cooking unit and the side walls of the cabinet.

9. The cooking appliance according to claim 8, further comprising:

side brackets provided at both widthwise side parts of the lower portion of the cabinet;

a rear bracket provided at a rear region of the lower portion of the cabinet;

one or more first air influx holes located on the side brackets; and one or more second air influx holes located on the rear bracket, wherein external air is introduced into the cabinet through the one or more first air influx holes and the one or more second air influx holes.

10. The cooking appliance according to claim 1, further comprising:

a rear panel installed at a rear portion of the cabinet at an area above the cabinet, the rear panel including a control command input unit configured to control the second cooking unit; and a first discharge hole that is provided on a front surface of the rear panel and that is configured to discharge at least a part of air flowing below the top plate and air flowing within the cabinet to outside of the cooking appliance.

11. The cooking appliance according to claim 10, wherein the cabinet includes a rear wall configured to cover the rear portion of the cabinet, further comprising:

one or more second discharge holes that are provided on the rear wall and that are configured to discharge at least a part of air flowing below the top plate and air flowing within the cabinet to the outside of the cooking appliance.

12. The cooking appliance according to claim 11, further comprising one or more third discharge holes that are located on a rear surface part of the rear panel and that are configured to discharge at least a part of air flowing below the top plate and air flowing within the cabinet to the outside of the cooking appliance.

13. The cooking appliance according to claim 1:

wherein the blocking members include fixing ribs protruding toward both widthwise side walls of the cabinet; and wherein the fixing ribs are fixed to the upper ends of the widthwise side walls of the cabinet.

14. The cooking appliance according to claim 1, wherein the one or more first cooking units comprises multiple first cooking units.

15. The cooking appliance according to claim 1, wherein the blocking members are configured to prevent heat generated from the one or more first cooking units from being transmitted to the widthwise side parts of the top plate.

16. The cooking appliance according to claim 1, wherein the upper end of each blocking member is bent toward the second wall in the width direction of the top plate.

17. The cooking appliance according to claim 1, wherein each blocking member is configured to block airflow in the width direction between the first air flow channel and the second air flow channel.

* * * * *